US006250490B1

(12) United States Patent
Loftus

(10) Patent No.: US 6,250,490 B1
(45) Date of Patent: Jun. 26, 2001

(54) CONTAINER

(75) Inventor: Stephen Clive Loftus, Bloxwich (GB)

(73) Assignee: McKechnie UK Limited, West Midlands (GB)

( * ) Notice: Subject to any disclaimer, the term of this patent is extended or adjusted under 35 U.S.C. 154(b) by 0 days.

(21) Appl. No.: 09/399,043

(22) Filed: Sep. 21, 1999

(30) Foreign Application Priority Data

Jun. 28, 1996 (GB) ..... 9613632

(51) Int. Cl.[7] ..... B65D 21/00
(52) U.S. Cl. ..... 220/23.4; 220/1.5; 220/23.6
(58) Field of Search ..... 220/1.5, 23.4, 220/23.6

(56) References Cited

U.S. PATENT DOCUMENTS

| | | |
|---|---|---|
| 3,718,218 | 2/1973 | Shields . |
| 3,749,273 | 7/1973 | Wreghitt et al. . |
| 4,247,004 | 1/1981 | Bird . |
| 4,287,997 | 9/1981 | Rolfe et al. . |
| 4,405,057 | 9/1983 | Stein . |
| 4,760,921 | 8/1988 | Licari . |
| 4,819,820 | 4/1989 | Weiner . |

FOREIGN PATENT DOCUMENTS

| | | |
|---|---|---|
| 882 301 | 7/1980 | (BE) . |
| 0 330 473 A1 | 8/1989 | (EP) . |
| 692638 | 6/1953 | (GB) . |
| 894836 | 4/1962 | (GB) . |
| 2056412 | 3/1981 | (GB) . |

*Primary Examiner*—Steven Pollard
(74) *Attorney, Agent, or Firm*—Adams, Schwartz & Evans, P.A.

(57) ABSTRACT

Containers which can support like containers to form a stack each includes formations which interengage to allow a security tag to be introduced, to lock the containers against unauthorized separation. This makes a stack sufficiently secure and sufficiently heavy as to be unattractive to a pilferer.

39 Claims, 4 Drawing Sheets

CONTAINER

This patent application is a continuation of U.S. patent application Ser. No. 08/882,050 filed on Jun. 25, 1997. This application claims the priority date of Jun. 28, 1996, for United Kingdom patent application Ser. No. 9613632.0.

The present invention relates to containers and particularly, but not exclusively, to containers used in delivering goods to retail premises.

In some delivery arrangements, such as the delivery of newspapers to retail outlets, it is customary for the goods to be left outside the premises. In the case of newspapers, this is because they are delivered very early in the morning, before the premises are open or staffed. A security problem therefore exists. Newspapers left in this way may become damaged or soiled. Attempts have been made to reduce these problems by using protective shrink wrap covering, or cardboard cartons, and by placing straps or bands around a bundle of newspapers to discourage pilfering.

The invention provides a container system for delivery of goods to retail premises, comprising a plurality of containers and means associated with the containers for connecting together at least two containers while containing the said goods, to prevent unauthorised separation thereof and to form a group of containers which, when containing the said goods, is not readily manually lifted.

Preferably the containers are formed to protect their contents from external access while forming part of a group of containers, thereby protecting the contents against pilfering or tampering. The containers may comprise substantially continuous external surfaces and may be lidded.

At least one container may support a like container to create a group in the form of a stack.

Each container may comprise formations so located as to mate with respective corresponding formations of another like container with which the container forms a group. The formations may provide mechanical engagement. The formations may comprise hook means and a hookable portion. The hookable portion may be formed in the base region of the container, the hook means being formed to be at or near the top of the container when the container is in condition for stacking. The hook means may be formed on a lid member of the container.

The formations of each container may comprise apertures or recesses so located that respective apertures or recesses of two containers come into alignment when the containers are formed into a group, to allow security means to be introduced therethrough. The apertures and/or recesses are preferably formed in the base region of the container and at or near the top of the container. At least one of the apertures may be formed in a movable member having a first position in which the aperture will come into alignment as aforesaid when containers are formed into a group, and a second, stowed position in which the aperture is not available for alignment as aforesaid. The movable member may be hingedly or slidably attached to the container.

The container may comprise complementary formations which mate along one edge of grouped containers, the apertures being so located that when security means have been introduced as aforesaid, the mating formations are prevented from disengaging.

Preferably the container is generally rectangular, having side walls extending up from a base. The container may further comprise lid means, preferably attached to the container, such as by hinges. The lid means may comprise lid portions individually hinged to the containers and which may be brought together to close the mouth of the container.

The lid means may provide a surface on which a second container may be stacked.

Preferably a group of containers as aforesaid is too heavy to be readily liftable. A group may weigh in excess of 25 kgs.

A method of delivering goods to retail premises, in which goods are transported in a plurality of containers and in which at least two containers are connected together at the retail premises to be prevented from unauthorised separation thereof and to form a group of containers which is not readily manually lifted.

The method preferably utilises a container system as set out in any of the preceding definitions.

A container for use in the method or system set out above.

A container adapted to be connected together with at least one other container to form a group of containers, the group of containers being not readily manually liftable when containing the said goods, and there being means associated with the container for securing the container against unauthorised separation from the group.

Preferably the container is formed to protect its contents from external access while forming part of a group of containers, thereby protecting the contents from pilfering or tampering. The containers may comprise substantially continuous external surfaces and may be lidded.

Preferably the container may support a like container to form a stack.

The container may comprise formations so located as to mate with respective corresponding formations of another like container with which the container forms a group. The formations may provide mechanical engagement. The container may comprise hook means and a hookable portion. The hookable portion may be formed in the base region of the container, the hook means being formed to be at or near the top of the container when the container is in condition for stacking. The hook means may be formed on a lid member of the container.

The formations of each container may comprise apertures or recesses so located that respective apertures or recesses of two containers come into alignment when the containers are formed into a group, to allow security means to be introduced therethrough. The apertures and/or recesses are preferably formed in the base region of the container and at or near the top of the container. At least one of the apertures may be formed in a movable member having a first position in which the aperture will come into alignment as aforesaid when containers are formed into a group, and a second, stowed position in which the aperture is not available for alignment as aforesaid. The movable member may be hingedly or slidably attached to the container.

The container may comprise complementary formations which mate along one edge of grouped containers, the apertures being so located that when security means have been introduced as aforesaid, the mating formations are prevented from disengaging.

Preferably the container is generally rectangular, having side walls extending up from a base. The container may further comprise lid means, preferably attached to the container, such as by hinges. The lid means may comprise lid portions individually hinged to the containers and which may be brought together to close the mouth of the container. The lid means may provide a surface on which a second container may be stacked.

An embodiment of the present invention will now be described in more detail, by way of example only, and with reference to the accompanying drawings, in which.

The drawings show containers 10 which may each support a like container (FIG. 2) to form a stack. Each container comprises formations shown generally at 12 and 14 in FIG. 2 and which are located so that when two like containers are stacked, the formations 12,14 cooperate to allow security means to lock the containers against unauthorised separation.

Figure 1B:
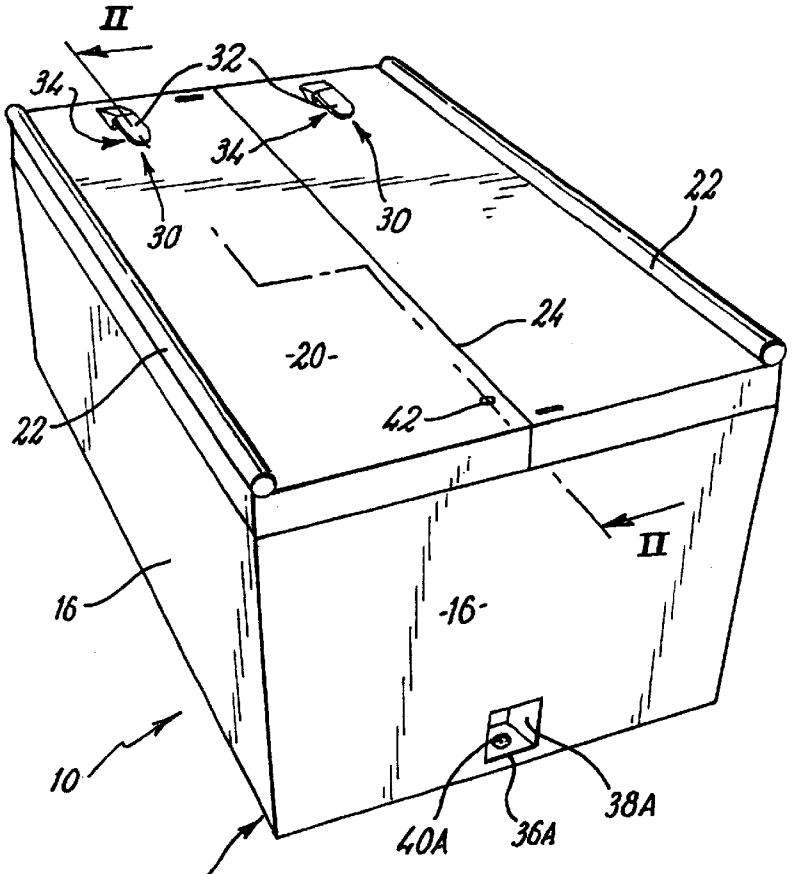
FIGS. 1A and 1B are schematic perspective views of a container according to the present invention from respective ends.
Figure 1A:
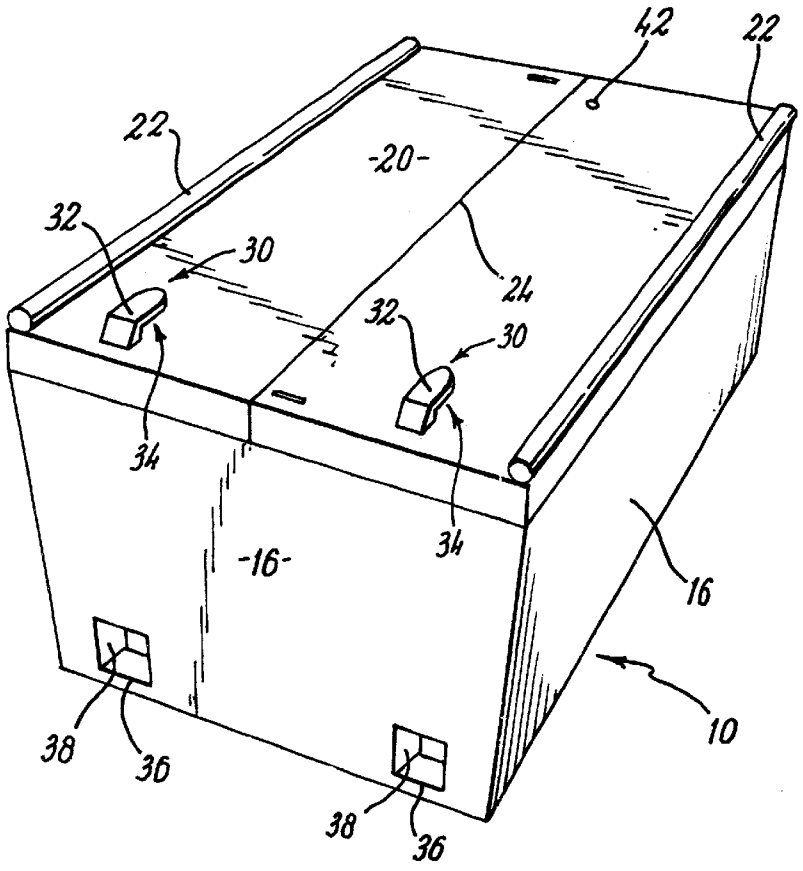
Figure 2:
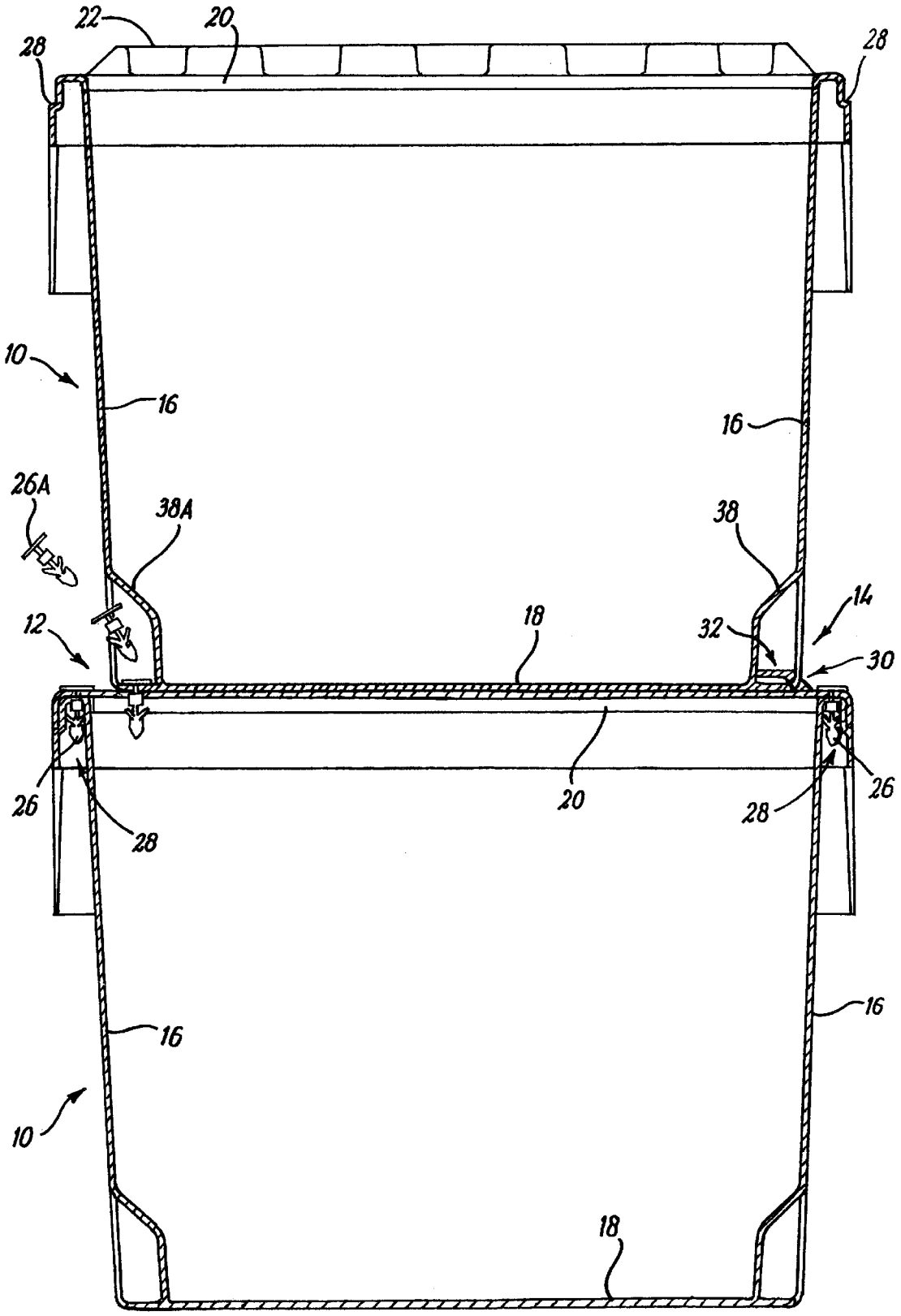
FIG. 2 is a section along the line II—II in FIG. 1B, showing two stacked containers in accordance with the invention.

In more detail, the container 10 is generally rectangular, having side walls 16 extending up from a base 18 and carrying a lid 20. In FIG. 1, the lid 20 comprises two lid flaps hinged to side walls along the edges 22, and meeting along a line 24. When closed, the lid 20 provides a platform on which a second container can rest to form a stack as shown in FIG. 2. In FIG. 2, the lower container has a closed lid which is secured by security tags 26 which are a snap fit through aligned holes in the lid 20 and a rim (at 28) of the container 10. The tags 26 secure the lid 20 against opening and thereby protect the container contents from pilfering or damage. Authorised removal of the tags 26 can be achieved by cutting the head off the tag with a knife or specially designed tool. The lid may then be opened.

The upper surface of the lid 20 has two hook formations 30 (FIG. 3) each having a generally horizontal end portion 32 beneath which there is a recess 34. The base 18 incorporates flanges 36 provided by re-entrant portions 38 of the wall 16, at the lower edge thereof.

Figure 3:
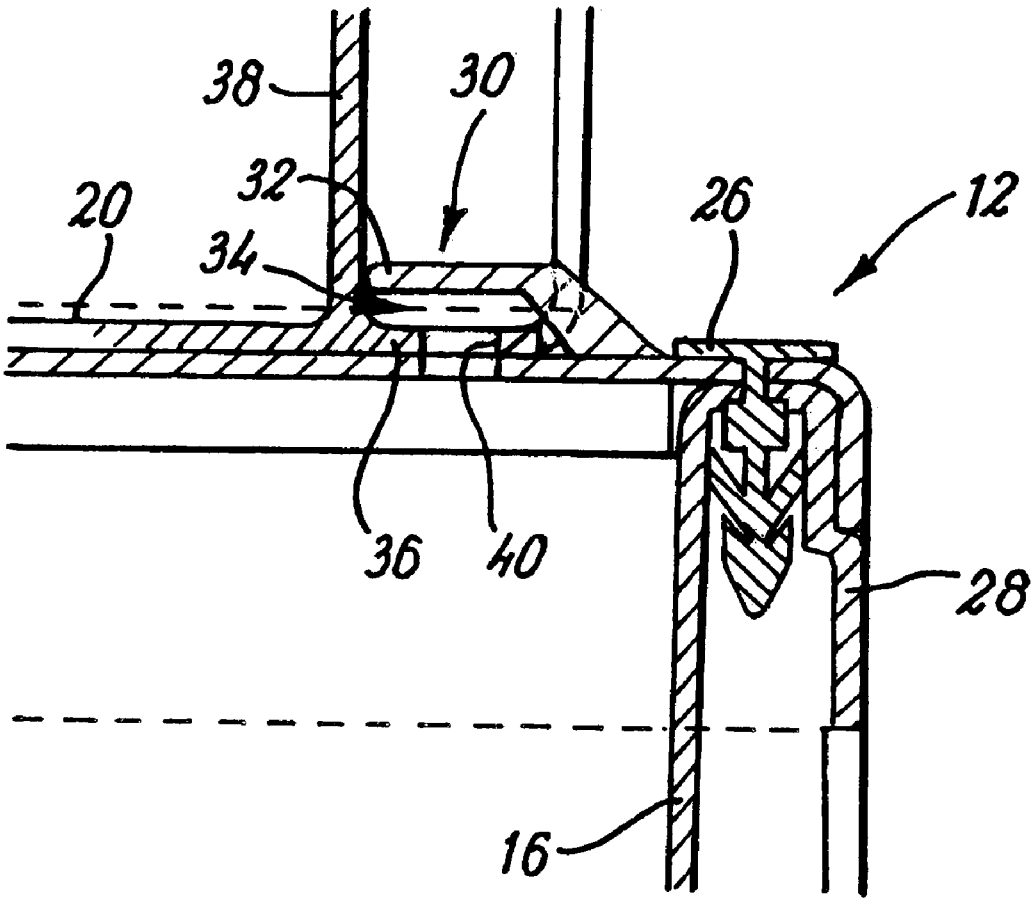
FIGS. 3 and 4 are enlarged details of the complementary formations shown in FIG. 2.

The hooks 30 and flanges 36 provide complementary formations which can mate (as shown in FIGS. 2 and 3) by sliding the flanges 36 into the recesses 34 under the end portions 32. This engagement holds down one edge of the container 10.

At the opposite edge, the containers can be locked together by further tags 26A, as follows. First, the lower edge of the container side wall again has a re-entrant portion 38A and flange 36A in which an aperture 40A is formed.

Figure 4:
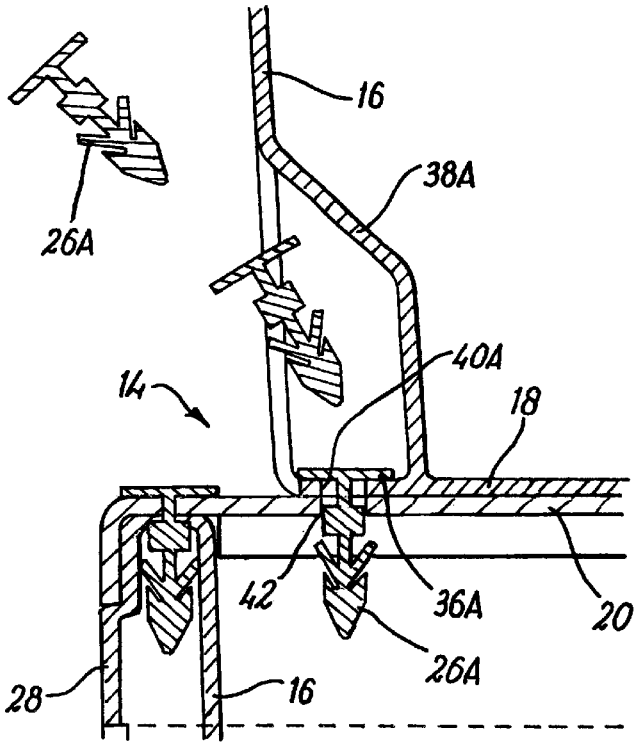

The aperture 40A is positioned so that when the upper container is properly seated on the lower container (with the flanges 36 under the hooks 30), the aperture 40A comes into alignment over a corresponding aperture 42 formed in the lid 20 (see FIG. 4); A security stage 26A can then be introduced from above the flange 36A, down through the aperture and locked into place. (Three tags are shown in FIG. 4 to illustrate this movement). This prevents the flange 36A from lifting. The hook 30 and flange 36 prevent the opposite edge of the upper container lifting. The tag 36A also prevents the containers sliding relative to one another (such as to disengage the hook 30 and flange 36). The two containers are therefore locked together in their stack and unauthorised separation is prevented. However, if the tag 26A is removed (as described above in relation to the tags 26) the containers can then be unstacked by authorised users.

An advantage of the arrangement described above is that the complete container (with the exception of the lid) can be formed as a single injection moulded plastics component to which a lid is added.

Figure 5:
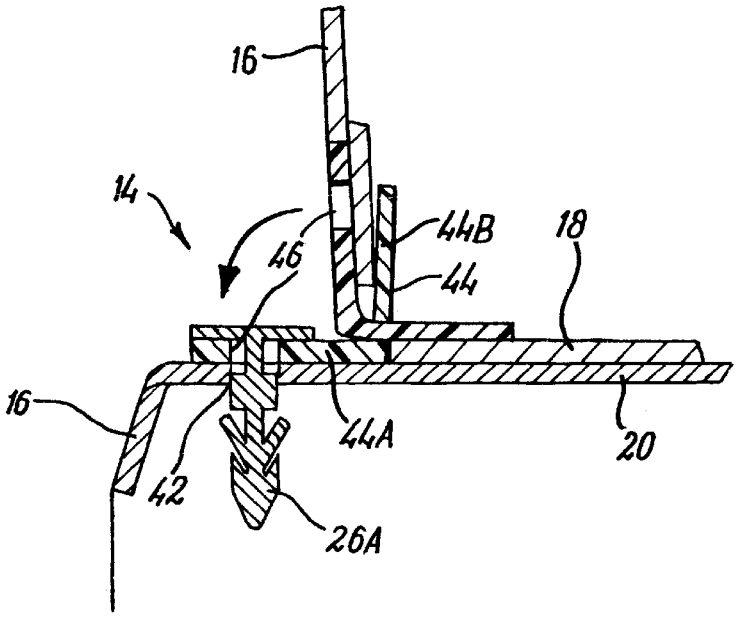
FIG. 5 shows an alternative arrangement to the arrangement shown in FIG. 4.

An alternative arrangement is shown in FIG. 5. In this case, the flange 36A is replaced by a hinged member 44 which is generally L-shaped, having two generally perpendicular limbs. The member 44 is hinged at the bottom corner of the container 10 to swing between an extended position 44A, to a stowed position 44B. The member 44 may be a plastics extrusion having an aperture 46 formed therein, corresponding to the aperture 40A. Consequently, when the member 44 is in the extended position, a container 10 can be stacked on a lower container 10 to bring the aperture 46 into alignment with the aperture 42 and allow tags 26A to be introduced as aforesaid. The opposite edges of the containers will be held together by the arrangement shown in FIG. 4 and described above. When the security feature is not being used, the member 44 can be swung to the stowed position to be protected from damage. It will be apparent that alternative hinge arrangements could be used, or stowed and extended positions could be provided in other ways, e.g. by slidable mounting of a member on the container.

For the newspaper delivery application described above, it is envisaged that containers may have horizontal dimensions of about 600 mm by 400 mm, and a height of about 300 mm. Typically, four or five containers would need to be delivered to a single retail outlet. By grouping together the containers being delivered, for instance into a single stack, and securing each to another container in the group, in the manner which has been described, a group of containers can be formed which is not readily manually liftable. That is, the group is too heavy (when containing newspapers) or too cumbersome. It is envisaged that a group weighing at least 25 kgs will be sufficiently difficult to lift that theft, tampering etc. will be deterred. Without the benefit of the invention, individual locked containers could be removed and broken into elsewhere but it is expected that the difficulty of handling a complete coupled stack will deter or prevent theft, tampering or pilfering. Groups are preferably formed by stacking, but containers could be horizontally grouped. Containers can be sturdy to protect against weather or other damage. It will be clear from the drawings that the containers shown have substantially continuous outer surfaces so that the contents of the group are protected from external access and thus from tampering, weathering, etc. The containers can usefully be returnable and re-usable and may be used for returning unsold goods.

The skilled reader will realise from the above description that many variations and modifications can be made to the containers described, without departing from the scope of the present invention. In particular, the containers may use a variety of different forms of lid, which may be permanently or removable attached to the containers and may be one part or multi part, hinged or otherwise attached. In some cases, other arrangements for supporting one container on another (such as stacking bars) could be used, particularly if the container shape allows the base of one container to fully close the mouth of a container below so that a lid is not necessary except for the uppermost container. Other shapes and dimensions of container could be used and other manufacturing processes and materials could be used. The containers could be used for many purposes other than retail delivery as described. The containers have been described above as forming a stack but it is envisaged that for some circumstances, it may be appropriate to allow for containers to be locked, together when wholly or partially nested. The term "stack" is therefore used broadly to encompass both alternatives.

Whilst endeavouring in the foregoing specification to draw attention to those features of the invention believed to be of particular importance it should be understood that the Applicant claims protection in respect of any patentable feature or combination of features hereinbefore referred to an/or shown in the drawings whether or not particular emphasis has been placed thereon.

I claim:

1. A container system for delivery of goods to retail premises, comprising a plurality of containers which are manually liftable when containing the said goods, there being means associated with the containers for connecting together at least two containers while containing the said goods, to prevent unauthorized separation thereof and to form a group of containers which, when containing the said goods, is not readily manually lifted, each container comprising formations which mate with respective corresponding formations of another like container when connected therewith, each container further comprising apertures or recesses which are remote from the mating formations and come into alignment when containers are connected, to allow security means to be introduced through aligned apertures or recesses of connected containers, to engage both containers, the mating formations serving, when mated, to prevent connected containers moving apart from one another, and the security means serving, when engaged, to prevent the mating formations being de-mated by relative movement of the connected containers.

2. A system according to claim 1, wherein the containers are formed to protect their contents from external access while forming part of a group of containers, thereby protecting the contents against pilfering or tampering.

3. A system according to claim 2, wherein the containers comprise substantially continuous external surfaces.

4. A system according to claim 2, wherein the containers are lidded.

5. A system according to claim 1, wherein at least one container is formed to support a like container to create a group in the form of a stack.

6. A system according to claim 1, wherein the formations provide mechanical engagement.

7. A system according to claim 1, wherein the formations comprise hook means and a hookable portion.

8. A system according to claim 7, wherein the hookable portion is formed in the base region of the container, the hook means being formed to be at or near the top of the container when the container is in condition for stacking.

9. A system according to claim 7, wherein the hook means is formed on a lid member of the container.

10. A system according to claim 1, wherein the apertures and/or recesses are formed in the base region of the container and at or near the top of the container.

11. A system according to claim 1, wherein at least one of the apertures is formed in a movable member having a first position in which the aperture will come into alignment as aforesaid when containers are formed into a group, and a second, stowed position in which the aperture is not available for alignment as aforesaid.

12. A system according to claim 11, wherein the movable member is hingedly or slidably attached to the container.

13. A system according to claim 1, wherein the containers are generally rectangular, having side walls extending up from a base.

14. A system according to claim 1, wherein the containers further comprise lid means.

15. A system according to claim 14, wherein the lids are attached to the containers.

16. A system according to claim 14, wherein the lid means comprise lid portions individually hinged to the containers and able to be brought together to close the mouth of the container.

17. A system according to claim 14, wherein the lid means provide a surface on which a second container may be stacked.

18. A system according to claim 1, wherein a group of containers as aforesaid is too heavy to be readily liftable.

19. A system according to claim 18, wherein a group may weigh in excess of 25 kgs.

20. A container for use in delivering goods to retail premises, the container being manually liftable when containing the said goods, and being adapted to be connected together with at least one other container to form a group of containers, the group of containers being not readily manually liftable when containing goods, and there being securing means associated with the container for securing the container against unauthorized separation from the group, the securing means comprising matable formations arranged to locate with respective corresponding formations of another like container when connected therewith, and comprising at least one aperture or recess remote from the matable formations and positioned to come into alignment with a corresponding aperture or recess in another container to which the container is connected, to allow security means to be introduced through the aligned apertures or recesses to engage both containers, the matable formations serving, when mated, to prevent connected containers moving apart from one another, and the security means serving, when engaged, to prevent the matable formations being de-mated by relative movement of the connected containers.

21. A container according to claim 20, wherein the container is formed to protect its contents from external access while forming part of a group of containers, thereby protecting the contents from pilfering or tampering.

22. A container according to claim 21, wherein the container comprises substantially continuous external surfaces.

23. A container according to claim 20, wherein the container is lidded.

24. A container according to claim 20, wherein the container may support a like container to form a stack.

25. A container according to claim 20 and comprising formations so located as to mate with respective corresponding formations of another like container with which the container forms a group.

26. A container according to claim 25, wherein the formations provide mechanical engagement.

27. A container according to claim 25, comprising hook means and a hookable portion.

28. A container according to claim 27, wherein the hookable portion is formed in the base region of the container, the hook means being formed to be at or near the top of the container when the container is in condition for stacking.

29. A container according to claim 27, wherein the hook means are formed on a lid member of the container.

30. A container according to claim 20, wherein the apertures and/or recesses are formed in the base region of the container and at or near the top of the container.

31. A container according to claim 20, wherein at least one of the apertures is formed in a movable member having a first position in which the aperture will come into alignment as aforesaid when containers are formed into a group, and a second, stowed position in which the aperture is not available for alignment as aforesaid.

32. A container according to claim 28, wherein the movable member is hingedly or slidably attached to the container.

33. A container according to claim 20, and comprising complementary formations which mate along one edge of grouped containers, the apertures being so located that when security means have been introduced as aforesaid, the mating formations are prevented from disengaging.

34. A container according to claim 20, wherein the container is generally rectangular, having side walls extending up from a base.

35. A container according to claim 20, and comprising lid means.

36. A container according to claim 35, wherein the lid means are attached to the container.

37. A container according to claim 35, wherein the lid means comprise lid portions individually hinged to the containers to be brought together to close the mouth of the container.

38. A container according to claim 35, wherein the lid means provide a surface on which a second container may be stacked.

39. An interlocking container assembly formed of stackable containers, comprising:

(a) a first container having a base, a plurality of side walls formed with said base, and a top;

(b) first and second recesses formed in respective opposing side walls of said first container adjacent said base, said first and second recesses defining respective first and second bottom interior flanges;

(c) a second container stacked beneath said first container, and having a base, a plurality of side walls formed with said base, and a top;

(d) a locking hook attached to the top of said second container and received within the first recess of said first container adjacent said first interior flange;

(e) an aperture formed in the top of said second container a spaced-apart distance from said hook and aligned with a corresponding aperture formed in the second interior flange of said first container; and (f) a locking security tag inserted through said aligned apertures formed in the top of said second container and the second interior flange of said first container, and cooperating with the hook of said second container and the first interior flange of said first container to hold said first and second containers together in the stacked condition, whereby said containers are secured against unauthorized separation from the assembly and are not readily manually lifted.

* * * * *